United States Patent [19]

Matsumura et al.

[11] Patent Number: 4,667,634

[45] Date of Patent: May 26, 1987

[54] METHOD AND APPARATUS FOR CONTROLLING AMOUNT OF FUEL INJECTED INTO ENGINE CYLINDERS

[75] Inventors: Toshimi Matsumura, Aichi; Takashi Hasegawa, Tajimi; Takahiro Hayakawa, Kariya; Shinya Sumitani, Anjo, all of Japan; Shuji Sakakibara, Rancho Palos Verdes, Calif.

[73] Assignee: Nippondenso Co., Ltd., Kariya, Japan

[21] Appl. No.: 763,989

[22] Filed: Aug. 9, 1985

[30] Foreign Application Priority Data

Aug. 10, 1984 [JP] Japan ..... 59-168694

[51] Int. Cl.[4] ..... F02D 41/40

[52] U.S. Cl. ..... 123/357; 123/436

[58] Field of Search ..... 123/357, 436, 480, 449, 123/503

[56] References Cited

U.S. PATENT DOCUMENTS

| | | | |
|---|---|---|---|
| 4,418,669 | 12/1983 | Johnson et al. | 123/480 X |
| 4,475,511 | 10/1984 | Johnson et al. | 123/436 |
| 4,503,821 | 3/1985 | Miyaki et al. | 123/357 |
| 4,535,406 | 8/1985 | Johnson | 123/480 X |
| 4,539,956 | 9/1985 | Hengel et al. | 123/357 |

FOREIGN PATENT DOCUMENTS

| | | |
|---|---|---|
| 214627 | 12/1983 | Japan . |
| 214631 | 12/1983 | Japan . |
| 217742 | 12/1983 | Japan . |
| 82534 | 5/1984 | Japan . |
| 141729 | 8/1984 | Japan . |

OTHER PUBLICATIONS

"Digital Analyzer for Internal Combustion Engines", by C. K. Leung and J. J. Schira, SAE Technical Paper Series, pp. 63–68, No. 820207, Feb. 22 and 26, 1982.

*Primary Examiner*—Tony M. Argenbright

*Attorney, Agent, or Firm*—Cushman, Darby & Cushman

[57] ABSTRACT

Fuel amount control apparatus arranged to determine the amount of fuel to be fed to respective cylinder so that the scattering in torque generation throughout the cylinders is suppressed. Correction amounts are first obtained during idling, and these correction amounts are then modified using at least one engine parameter so that they can be used not only in idle state but also other operating states. To this end, a correction factor is computed using engine speed or the like so as to modify the correction amounts thereby. As a result, a basic fuel amount is corrected by correction factors provided for respective cylinders where the correction factors are further modified to be suitable for any engine operating conditions, providing smooth rotation without uncomfortable vibrations.

8 Claims, 8 Drawing Figures

METHOD AND APPARATUS FOR CONTROLLING AMOUNT OF FUEL INJECTED INTO ENGINE CYLINDERS

BACKGROUND OF THE INVENTION

The present application is related to the U.S. Pat. No. 4,503,821 patented Mar. 12, 1985 and co-pending application of Matsumura et al, Ser. No. 752,732, filed July 8, 1985, both commonly assigned.

This invention relates generally to a method and apparatus for controlling an amount of fuel injected into engine cylinders respectively so that torque generated by respective cylinders is uniform throughout the cylinders.

The amount of fuel injected into a multi-cylinder internal combustion engine has been conventionally controlled uniformly throughout all the cylinders in both gasoline engines and diesel engines. According to known electronic fuel injecting systems for gasoline engines, the valve-opening duration of electromagnetic valves respectively provided to individual cylinders is controlled such that the valve opening duration is common to all the cylinders. According to known electronically controlled diesel engines, which have been recently put in a practical application stage, the position of an injection amount-controlling member, such as a control rack or a spill ring, is controlled where the controlling member is common to all the cylinders.

Although such a control effected uniformly throughout all the cylinders of an engine is simple, there arises a problem of variation or scattering in injecting fuel amount throughout the cylinders. Therefore, in using conventional apparatus, high manufacturing precision is required when manufacturing various parts, such as injection valves, injection conduits or the like which are used in the injection system in order to reduce such cylinder-to-cylinder variation. Such high manufacturing precision or accuracy necessarily increases the manufacturing cost. Furthermore, even though the precision of the parts used have been increased to its limit so that cylinder-to-cylinder variation is minimized, the amount of fuel actually injected into engine cylinders may suffer from variation or scatter throughout cylinders due to secular change or external disturbance, such as a variation in actuating timing of intake and/or exhaust valves or the like.

Such a variation in amount of fuel injected into cylinders of an engine results in irregular rotation of the engine crankshaft. Especially during idling such irregular rotation is uncomfortable and noisy. Generally speaking, the engine rotational speed during idling is set to a low value in view of suppression of fuel consumption. On the other hand, it is desired, especially for passenger automobiles, that engine rotation during idling be as smooth as possible in order to provide comfortable environment. Particularly, the above-mentioned irregular rotation during idling is desired to be reduced to achieve stable engine rotation.

A method of correcting the amount of fuel as a countermeasure for resolving the above problem is known (see SAE No. 820,207 for instance). In this method, engine speed is detected before and after fuel injection or combustion at predetermined engine crank angles in connection with respective cylinders to that the amount of fuel supplied to respective cylinders is controlled such that the difference in engine speed between two measurements performed before and after fuel injection, becomes uniform throughout all the cylinders during idling state. In detail, this method utilizes the fact that the difference in engine speed between two measurements performed before and after fuel injection has a close relationship with torque generated by an associated cylinder.

However, since the above-mentioned known method can renew correction values or amounts suitable for idling state only, the renewed correction value cannot be used for other engine operating states or modes. In detail, when the renewed correction amounts are used for engine operation other than idling, vibrations and/or irregular rotation are apt to be greater due to the unbalance or unevenness of generated torque throughout cylinders caused from undesirably corrected amounts of fuel to respective cylinders.

SUMMARY OF THE INVENTION

The present invention has been developed in order to remove the above-description drawbacks inherent to the conventional fuel supply system of an internal combustion engine of the type arranged correct the amount of fuel for respective cylinders.

It is, therefore, an object of the present invention to provide new and useful method and apparatus for controlling the amount of fuel injected into engine cylinders so that variation in engine speed throughout the cylinders can be reduced in any engine operating conditions thereby engine rotation is stably controlled while uncomfortable vibrations or irregular rotation are removed.

According to a feature of the present invention correction values or amounts for correcting the cylinder-to-cylinder scattering of injected fuel amount are first obtained so that engine torque represented by instantaneous engine speed is uniform throughout all the cylinders in idle state, and this correction amounts are modified or corrected using engine operating conditions, such as engine speed, engine load etc so as to determine final amounts of fuel to be injected into respective cylinders. As a result, the modified correction amounts can be used throughout all engine operating conditions, providing smooth rotation and removing uncomfortable irregular vibrations.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 1:
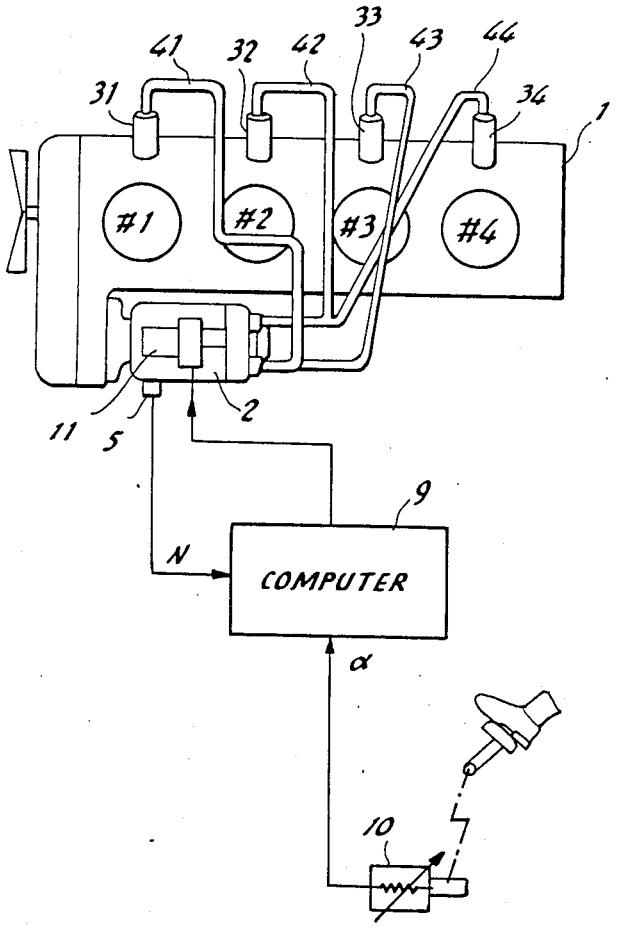
FIG. 1 is a schematic diagram showing an embodiment of the present invention.

Referring now to FIG. 1, a schematic diagram of an embodiment of the present invention is shown. FIG. 1 shows a known 4-cylinder diesel engine 1 arranged to receive fuel from a distributor injection pump 2 (for instance Bosch VE type pump) equipped with an electronic injecting amount control device (so called electronic governer). The injection pump 2 is driven at a speed one half the engine speed via an unshown belt or gear mechanism coupled to the engine crankshaft. Injection nozzles 31 through 34 are provided to individual cylinders of the engine 1 where the injection nozzles 31–34 are respectively coupled by injection steel conduits 41–44 to the distributor injection pump 2. The injection pump 2 is arranged to pressurize fuel led therein from an unshown fuel tank to deliver the same under pressure to respective injection nozzles 31–34 at predetermined timings so that a predetermined amount of fuel is supplied to combustion chambers or auxialiary chambers of respective cylinders of the engine 1.

The injection pump 2 is equipped with a rotational speed sensor 5 which produces an output signal indicative of the rotational speed of a rotary member of the injection pump 2. Since this rotary member rotates in synchronism with the engine rotation, the output signal from the rotational speed sensor 5 also represents the speed of the engine 1. The output signal from the rotational speed sensor 5 is fed to an electronic control unit (ECU) 9 which also receives a signal from a potentiometer 10 associated with an accelerator pedal. The electronic control unit 9 produces an output control signal by using these input signals to control the injection pump 2 so that a desired amount of fuel is injected as will be described in detail hereinlater.

Figure 2:
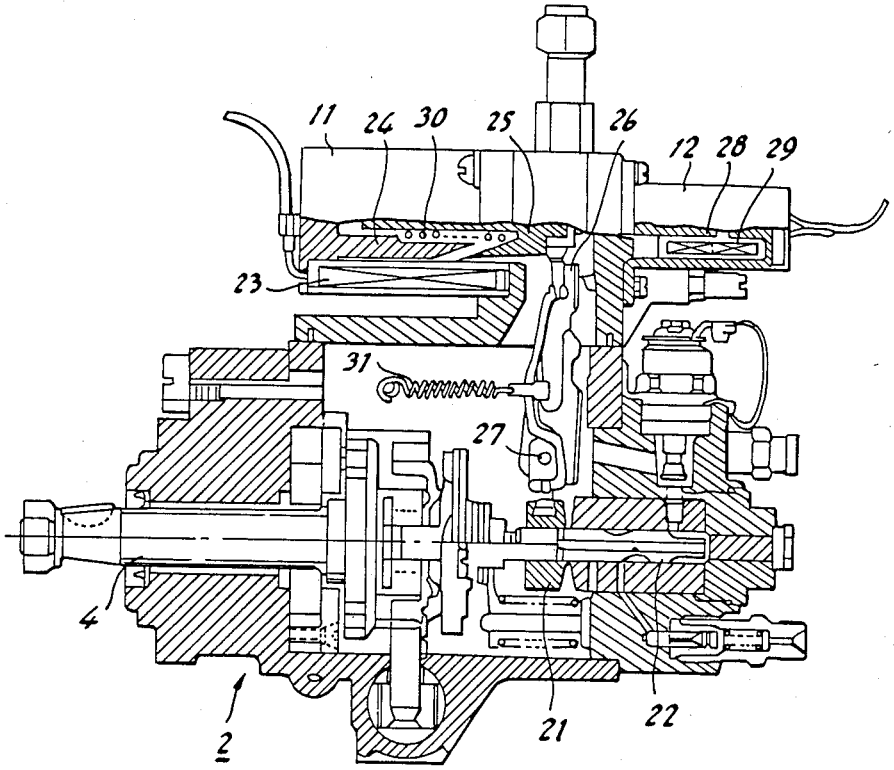
FIG. 2 is a partial cross-sectional view of the distributor injector pump of FIG. 1.
Figure 3:
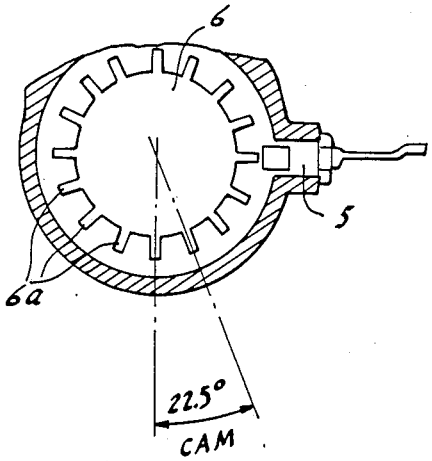
FIG. 3 is a cross-sectional view of the engine speed sensor in FIG. 1.

FIG. 2 shows a cross-sectional view of the injection pump 2 shown in FIG. 1. The injection pump 2 comprises a drive shaft 4 driven by the engine crankshaft. The above-mentioned rotational speed sensor 5 is arranged to detect the rotational speed of the drive shaft 4. Namely, the drive shaft 4 is equipped with a disc 6 having 16 projections or teeth 6*a* at its periphery as shown in FIG. 3, and an electromagnetic pickup functioning as the rotational speed sensor 5 is provided to be close to the locus of the projections 6*a*. The projections 6*a* are equiangularly spaced, and therefore, an angle between two consecutive projections with respect to the center of the disc 6 is 22.5 degrees. Since the drive shaft 4, and therefore the disc 6 rotates once per two revolutions of the engine crankshaft, eight projections 6*a* pass the sensor 5 to cause the same to produce eight pulses per one revolution of the engine crankshaft. In other words, the rotational speed sensor 5 produces a pulse output signal each time the engine crankshaft rotates 45 degrees. The pulse output signal from the sensor 5 is referred to as a signal N. This signal N represents not only the rotational speed of the engine 1 but also rotation of the engine crankshaft by a given crank angle, and is fed to a computer used as the electronic control unit 9.

The above-mentioned potentiometer 10 produces a voltage signal indicative of the stroke of the accelerator pedal, thereby representing the load $\alpha$ of the engine 1. Therefore, this potentiometer 10 is referred to as a load sensor hereinafter. The computer 9 thus determines an amount of fuel to be injected into engine cylinders, which amount is most suitable for engine operating conditions varying time to time. In order to control the fuel injection amount, an injection amount control actuator 11 such as a linear solenoid, included in the injection pump 2 is controlled by the output control signal from the computer 9.

A detailed structure of the distributor injection pump 2 will be described with reference to FIGS. 2 and 3. The injection pump 2 is basically the same as the known VE type injection pumps made by Bosch such that the mechanism for fuel intaking, fuel transmission under pressure, and fuel distribution, and injection timing are the same as those in the VE type injection pumps. Therefore description of such known features is omitted. However, the injection pump 2 used in the present invention differs from the known pump in that the axial displacement of a spill ring 21, which is a member for adjusting a spilling amount of fuel, is controlled by the above-mentioned actuator 11 using the linear solenoid, thereby controlling an injection amount by the computer 9.

When the control output signal from the computer 9 is applied to a coil 23 of the actuator 11 having a stator 24 and a movable core 25, a magnetic force proportional to the intensity of the control signal, occurs between the stator 24 and the movable core 25. As a result, the movable core 25 is drawn leftward in the drawing against a biasing force of a spring 30. As the movable core 25 moves leftward, a lever 26 attached to the movable core 25 at its one end is rotated counterclockwise in the drawing around a pivot 27. The other end of the lever 26 is connected to a spill ring 21, and therefore the spill ring 21 is moved to the right in the drawing when the lever rotates counterclockwise. In a VE type injection pump, the larger the rightward movement of the spill ring 21, the later the spill timing, and therefore an instant of termination of fuel injection is retarded. As a result, the amount of injecting fuel is increased. As described in the above, the increase in an the current to the actuator 11 results in increase in the amount of injecting fuel, while the decrease in the current results in a decrease in the fuel amount. Accordingly, when the current to the actuator 11 is controlled by the computer 9, it is possible to control the amount of fuel to be injected into the engine cylinders.

A position sensor 12 is provided such that it is attached coaxially with the actuator 11 for increasing the control accuracy by correcting the current to the actuator 11. The position sensor 12 comprises a probe 28, which is coaxial and integral with the moving core 25 and made of ferrite or the like, and a position-detecting coil 29.

Fuel injecting amount is normally controlled by the computer 9 by using the above-mentioned signal N and the output signal from the load sensor 10 such that the current to the actuator 11 is controlled so that the position of the movable core 25 thereof is controlled to determine an optimal position of the spill ring 21. However, when the fuel amount is determined by the above normal control, the amount of fuel injected into respective cylinders of the engine 1 is uniformly determined. Therefore, if there is a variation of valve-opening pressures of respective injection nozzles 31–34, the amount of fuel injected into respective cylinders suffers from scattering accordingly. In order to minimize such variation throughout respective cylinders, a correction processing is effected by way of operation of the computer 9 so that the object of the present invention set forth at the beginning of this specification will be attained.

Figure 4:
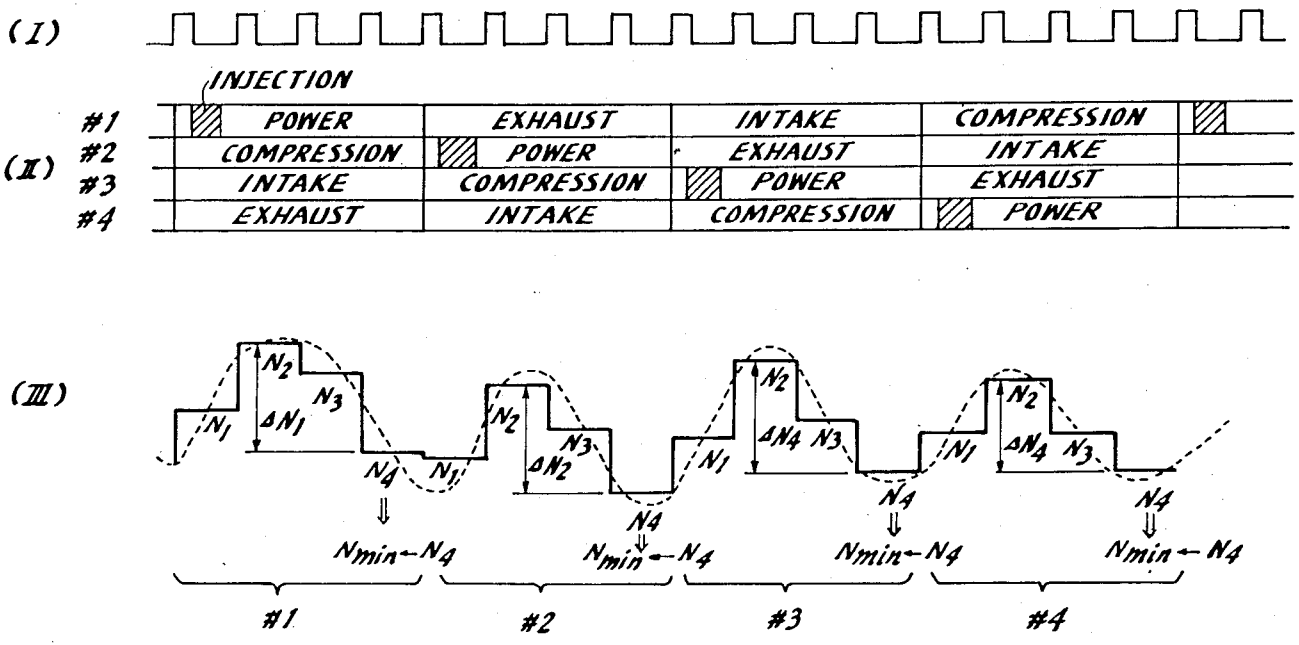
FIG. 4 is an explanatory timing chart showing the operation of the embodiment of FIG. 1.

First of all, the concept of the control for the above-mentioned correction processing will be described with reference to FIG. 4. In FIG. 4, the reference (I) indicates the above-mentioned signal N, while the reference (II) indicates a sequence chart of the operation of the 4-cylinder diesel engine 1. In the sequence chart (II) of FIG. 4, hatched portions show timings of fuel injection to respective cylinders, while references #1 to #4 indicate cylinder numbers. During idling, to which the present invention is mainly adapted, fuel injection is effected when several degrees of crank angle are passed after the top dead center. The reference (III) in FIG. 4 indicates an output signal obtained by frequency-to-voltage converting the signal N by the computer 9. This signal (III) represents variation in rotation at every 45 degrees of the engine crankshaft rotation. Observing precisely the signal (III) in correspondence with the injection (intake) stroke and power (combustion) stroke within each cylinder, the rotational speed represented by the signal N rapidly increases immediately after combustion, and then lowers as a compression stroke within a next cylinder starts taking place.

Therefore, the minute changes of the signal N have a period corresponding to one half the engine rotation, while it is known from experiments that a maximum value and a minimum value of the change appears at every 90 degress of the engine crankshaft rotation. Asssuming that the difference between the maximum and minimum values of the change in the rotational speed of each cylinder is expressed in terms of $\Delta Nj$ (wherein j is a numeral indicative of a number of a cylinder on power stroke), it is known that the value of $\Delta Nj$ is in correlation with generated torque. Therefore, if the value of $\Delta Nj$ is made common to all the cylinder, smooth rotation during idling would result. To this end, in the present embodiment a mean value of $\Delta N1$ through $\Delta N4$ is obtained such that $\Delta N = \Sigma \Delta Nj/4$. Then the amount of fuel to be injected into individual cylinders is controlled so that each value of $\Delta Nj$ equals the mean value $\Delta N$. In practice, the mean value $\Delta N$ is obtained by using information of the newest 4 times of combustion each time $\Delta Nj$ is detected. Then, when $\Delta Nj$ is greater than $\Delta N$, the amount of fuel fed to the cylinder is reduced. On the other hand, when $\Delta Nj$ is smaller than $\Delta N$, the amount of fuel fed to the cylinder is increased.

In the embodiment, since the signal N is a pulse train whose each pulse is simply produced at every 45 degrees of the crankshaft rotation, it cannot be determined which cylinder is the one on combustion (power stroke) from the information of the signal N. It is possible to determine which cylinder is on combustion if another sensor and an associated disc attached to the cam shaft 4 of the injection pump 2 are provided to detect a particular timing, such as top dead center, of a particular cylinder such as the first cylinder. In this embodiment, however the determination of cylinders is effected by using a special program for the computer 9.

Figure 5:
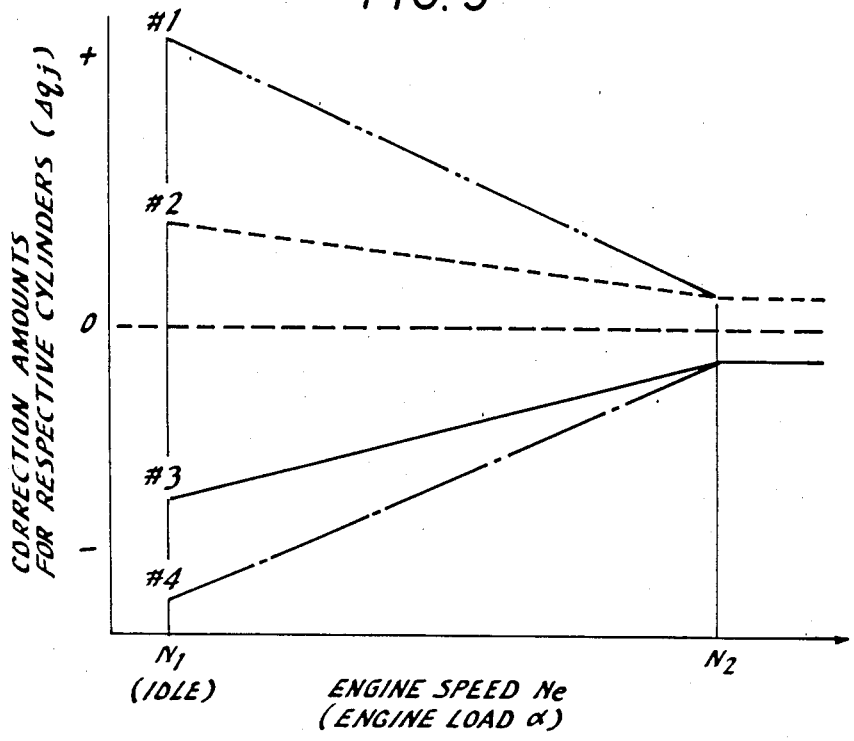
FIG. 5 is a graph showing necessary variation in correction amounts with respect to the change in engine speed or engine load.

During execution of the injection amount scattering correction described in the above, the amount of fuel to be injected for respective cylinders is corrected. It has been confirmed through experiments that the amount of correction decreases as the engine speed (or load) increases as shown in FIG. 5. Therefore, if the correction amount derived during idling is corrected using engine speed or load at a present time, variation in engine speed can be effectively suppressed in a state even other than idling.

Figure 6:
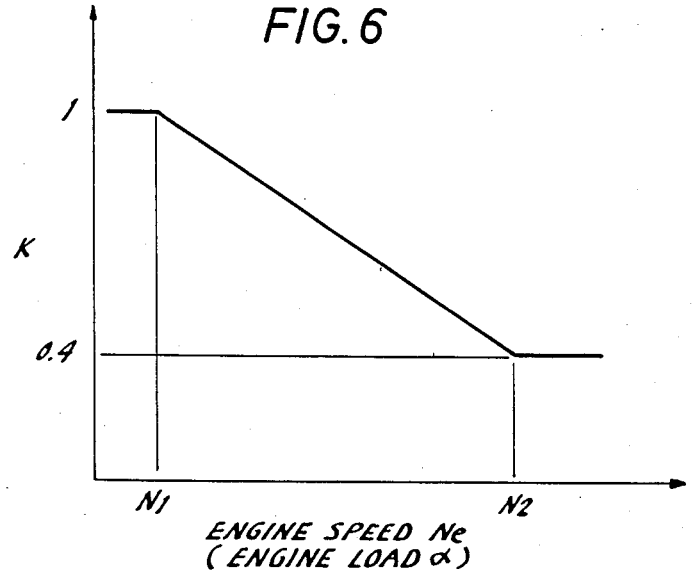
FIG. 6 is a graph showing a cahracteristic of a correction factor K used for modifying the correction amounts depending on engine speed or engine load.

In the present embodiment, correction amounts, which will be used for correcting a basic amount of fuel for obtaining actual amounts of fuel respectively injected into individual cylinders, are first obtained using engine speed information derived during idling, and then the correction amounts are modified by a correction factor K, which is determined by engine speed or load as shown in FIG. 6. With this operation, the correction amounts for respective cylinders are determined so as to finally determine the amount of control.

Figure 7:
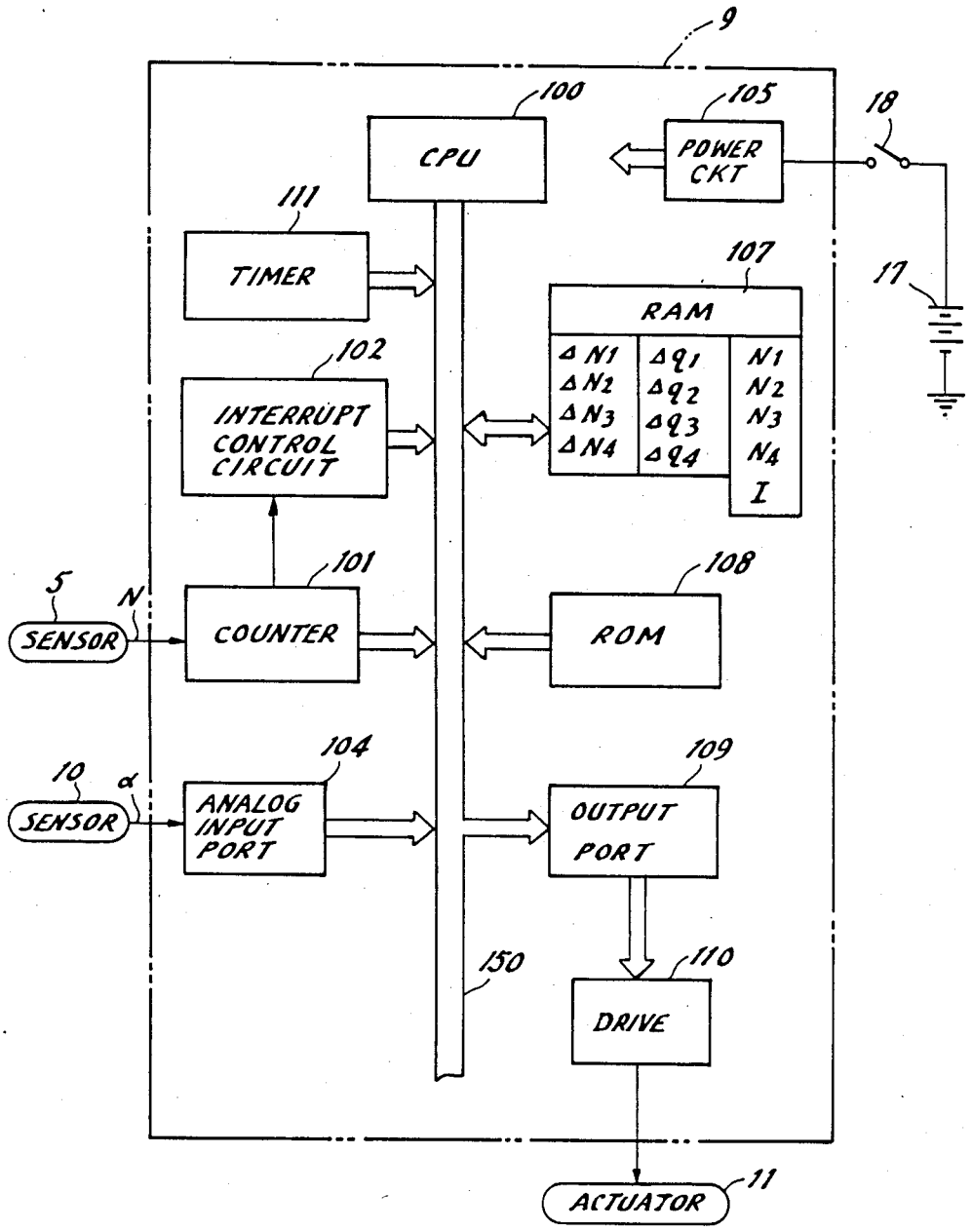
FIG. 7 is a schematic block diagram of the computer of FIG. 1.
Figure 8:
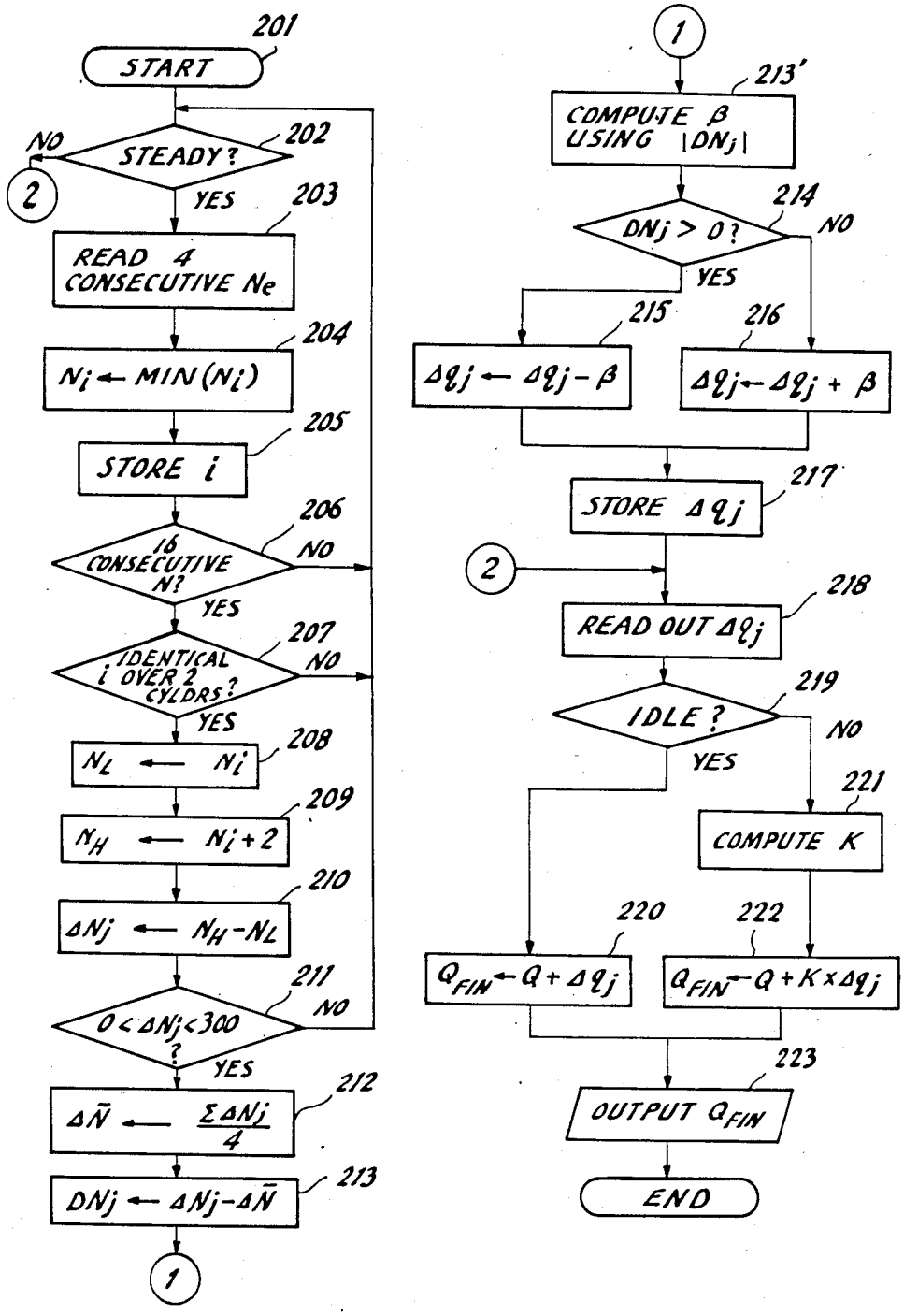
FIG. 8 is a flowchart showing a program provided for the computer of FIG. 7.

Now detailed structure and operation of the embodiment will be described with reference to FIGS. 7 and 8. FIG. 7 shows a schematic diagram of the computer 9 used as the electronic control unit and its peripheral circuits. In FIG. 7, the reference 100 is a central processing unit (CPU) which performs operations necessary for the control of the amount of fuel respectively fed to engine cylinders. The reference 101 is a counter responsive to the signal N. Namely, the counter 101 counts the number of pulses included in the signal N sent from an electromagnetic pickup operating as the rotational speed sensor 5, and the count per unit time represents the engine rotational speed. The counter 101 also produces an interruption-control signal in synchronization of the engine rotation, and sends the interruption-control signal to an interruption control circuit 102 at an interval of 45° CA (crank angle) corresponding to 22.5 degrees of the rotational angle of the cam shaft 4.

The interruption control circuit 102 sends an interruption signal via a common bus 150 to the CPU 100 in response to the interruption-control signal.

The reference 104 is an analog input port comprising an analog multiplexer and an analog-to-digital (A/D) converter. The analog input port 104 is responsive to the load signal indicative of the opening degree of the accelerator pedal, from the engine load sensor 10 for A/D converting the same to prepare digital data which is read into the CPU 100. Output data from these circuits or units 101, 102 and 104 is transmitted via the common bus 150 to the CPU 100. The reference 105 is a power source circuit which is connected via a key switch 18 to a battery 17 mounted on a motor vehicle for the supply of power to the computer 9.

The reference 107 is a random-access memory RAM which is capable of reading and writing data and is temporarily used during the execution of a program. The RAM 107 has an address space for storing various data, such as increment in rotational speed $\Delta N1$ to $\Delta N4$ at every combustion, correction amounts $\Delta q1$ to $\Delta q4$ used for correcting the current to the actuator 11 each time of combustion, rotational speed data N1 to N4 inputted at every 45° CA and stored till the end of power stroke, and determined cylinder number I.

The reference 108 is a read-only memory in which the operational program of the computer 9 and various constants are prestored.

The reference 109 is an output port which sets the amount of the control current, which is fed to the actuator 11, in a drive circuit 110 by using the result of calculation executed by the CPU 100 so that the drive circuit 110 produces the control current by converting the output signal from the output port 109 to an actual driving current fed to the above-mentioned linear solenoid actuator 11.

The reference 111 is a timer which measures lapse of time to send the same to the CPU 100. As described in the above, the counter 101 produces interruption-control signal every 45° CA by counting the number of pulses of the signal N to cause the interruption control circuit 102 to produce the interruption signal. Therefore, the CPU 100 executes an interrupt service routine periodically as will be described hereinlater. In the above, 45° CA corresponds to 22.5° rotation of the toothed disc 6 shown in FIG. 3.

The operation of the computer 9 for the control of fuel injection will be described hereinafter with reference to a flowchart of FIG. 8. FIG. 8 shows an interrupt service routine in which the correction amounts are updated during idling and the correction amounts are modified to be suitable for engine operating state other than idling when the engine is in other than idle state. Apart from this interrupt routine, an unshown main routine is provided for computing a basic amount Q of fuel to be injected using engine speed Ne and engine load $\alpha$. The engine speed Ne may be obtained using an average signal, for instance by averaging the signal N appearing at an interval of 90° CA. The output signal from the accelerator pedal sensor 10 may be used as the engine load $\alpha$. The way of computing the basic amount Q is disclosed in the above-mentioned U.S. Pat. No. 4,503,821, and therefore a further description thereof is omitted.

When the interruption occurs in the step 201, then it is checked whether the engine 1 is in steady state or transient state in a step 202. Here, "steady state" means a state in which idling lasts for a relatively long period of time. To determine the steady or transient state, the variation in engine speed Ne and engine load $\alpha$ may be detected. This step 202 is provided to determine whether correction amounts can be updated or not since the renewal or updating of correction amount should be done using information of variation in engine torque represented by engine speed which is changed by combustion only without influence of intentional acceleration or deceleration.

When it is determined that the engine 1 is in steady state in the step 202, a step 203 is executed to read four consecutive pulses of the signal N, which pulses are obtained at an interval of 45° CA, and then four engine speed data Ne are obtained. On the other hand, when the engine 1 is in transient state, the operational flow skips to a step 218. After the step 203, the lowest or minimum engine speed MIN(Ni) among the four data is detected and stored in the RAM in a step 204. Then in a step 205, a variable i indicative of crank angle position giving the minimum engine speed Ni is stored in the RAM as a minimum speed $N_L$.

In a following step 206, it is checked whether the signal N has been inputted such that 16 consecutive pulses thereof corresponding to four cylinders are received. If YES, the it is checked whether the variable i is identical over two or more cylinders in a step 207. If identical, the $i^{th}$ engine speed Ni is regarded as a minimum speed $N_L$of the cylinder, and an $(i+2)^{th}$ engine speed N(i+2) is regarded as a maximum speed $N_H$ of the cylinder. Then in a step 210, a difference between the maximum and minimum speeds is computed as $\Delta Nj = N_H - N_L$, and stored in the RAM.

In a step 211, it is checked whether ΔNj is between 0 and 300 to see if there is an influence by malfunction. In the case that ΔNj is out of this range betwen 0 and 300, the operational flow returns to the step 202. On the other hand, when the condition for checking malfunction is satisified, i.e. when ΔNj is in the range, a step 212 is executed to compute an average value ΔN of the variation in engine speed of the four cylinders. Then in a step 213, a difference DNj between the variation ΔNj in engine speed of each cylinder and the average engine speed ΔN of the four cylinders is obtained. This difference DNj is referred to as a deviation of each cylinder. In a following step 213', an absolute value |DNj| of the deviation DNj is detected, and a unit correction amount $\beta$ is derived using the absolute value |DNj|. For instance, the unit correction amount $\beta$ may be picked up from map or computed using a given formula. Then it is checked whether the deviation DNj is either positive or negative in a step 214. When posititive, a correction amount Δqj for each cylinder is corrected by subtracting the unit correction amount $\beta$ in a step 215. On the contrary, when negative, the correction amount Δqj for each cylinder is corrected by adding the unit correction amount $\beta$ in a step 216. In this way, the correction amount Δqj is updated and stored in the RAM in a step 217.

Following the step 217 or the step 202, the correction amount Δqj is read out from the RAM in a step 218. Then in a step 219, it is checked whether the engine 1 is in idle state or not. In the case of idle state, a step 220 is executed to modify the basic fuel amount Q by simply adding the correction amount Δqj so as to produce a final amount $Q_{FIN}$ of fuel to be injected. In the case of other state, aforementioned correction factor K is first computed or derived from a map in a step 221. Then in a step 222, the correction factor K is used to modify the correction amount Δqj before it is added to the basic amount Q of fuel to obtain the final amount $Q_{FIN}$. After the final amount $Q_{FIN}$ is determined in either the step 220 or 222, a step 223 is executed to output the final amount QFIN so that corresponding amount of fuel is injected into designated cylinders respectively.

Although the value of the correction factor K is obtained using engine speed Ne or engine load $\alpha$ in the above-described embodiment, the value of K may be computed or derived using both the engine speed Ne and engine load $\alpha$. For instance, a two-dimensional map by way of these two parameters may be used to derive a suitable value of the correction factor K. Furthermore, the amount of fuel injection, governor lever opening degree or the like may be used in addition to engine speed Ne and engine load $\alpha$ for determining the value of K.

From the foregoing description it will be understood that information for correcting the amount of fuel to respective cylinders during idling for causing the engine to produce an identical torque throughout all the cylinders is now used not only in idle state but also in other operating states with the correction amount being corrected using engine parameter(s). Therefore, the engine can be operated smoothly without uncomfortable vibrations or irregular rotation throughout all the operating range.

The above-described embodiments are just examples of the present invention, and therefore, it will be apparent for those skilled in the art that many modifications and variations may be made without departing from the spirit of the present invention.

What is claimed is:

1. A method for controlling the amount of fuel injected into a multi-cylinder internal combustion engine, comprising the steps of:

(a) detecting an engine speed only when said engine is in a steady idle state for each of the cylinders of the engine before and after combustion, to obtain a torque variation caused by combustion in in each of the cylinders;

(b) obtaining a difference between engine speeds measured before and after combustion for each of the cylinders;

(c) producing correction amounts used for correcting a basic fuel amount to be injected to respective cylinders so that said difference will be identical throughout all the cylinders;

(d) modifying said correction amounts using at least one engine parameter to modify said correction amounts to be accurate for engine operation other than idling; and (e) finally determining a fuel amount for each cylinder by correcting said basic fuel amount using said correction amounts which have been modified.

2. A method as claimed in claim 1, wherein said at least one engine parameter includes engine speed.

3. A method as claimed in claim 1, wherein said at least one engine parameter includes engine load.

4. A method as claimed in claim 3, wherein said engine load is detected by measuring a stroke of an accelerator pedal of said engine.

5. A method as claimed in claim 1, wherein said step of modifying comprising the steps of:

(a) determining whether said engine is in idle state;

(b) computing a correction factor K using said at least one engine parameter when said engine is not in idle state;

(c) modifying said correction amounts by multiplying said correction factor K thereto, said multiplying of correction amounts by said correction factor K not being performed when said engine is in said idle state.

6. Apparatus for controlling the amount of fuel injected into a multi-cylinder internal combustion engine, comprising:

means for detecting a rotational speed of said engine at predetermined intervals only when the engine is in a steady idle state to produce a plurality of engine speed data N for each of the cylinders of said engine so as to detect the variation in torque caused by each combustion;

means for detecting operational parameters of said engine including engine load;

computing means for:

(a) obtaining a minimum engine speed $N_L$ and a maximum engine speed $N_H$ from a plurality of engine speed data Ni for each cylinder wherein "i" is a positive integer indicating a crank angle position where engine speed data is detected;

(b) obtaining a difference $\Delta Nj = NH - NL$ between said minimum and maximum engine speed data for each of said cylinders wherein "j" is a positive integer indicating a cylinder number;

(c) obtaining an average difference $\Delta N$ using a plurality of difference values $\Delta Nj$ computed for each of said cylinders;

(d) obtaining a deviation by subtracting said average difference $\Delta e,ovs/N/$ from said difference $\Delta Nj$ for each of said cylinders;

(e) obtaining a unit correction factor $\beta$ using an absolute value of said deviation for each of said cylinders;

(f) updating a correction amount $\Delta qj$ using said unit correction factor $\beta$ in accordance with the value of said deviation;

(g) determining whether said engine is in idle state;

(h) computing a correction factor K using said at least one engine parameter when said engine is not in said idle state;

(i) modifying said correction amounts $\Delta qj$ by multiplying said correction factor K thereto, said correction amounts $\Delta qj$ not being multiplied by said correction factor K when said engine is in said idle state;

(j) obtaining a basic fuel amount Qj for each of said cylinders using engine speed data and engine load data;

(k) correcting said basic fuel amount Qj by said correction amounts $\Delta qj$ which have been modified if said engine is not in said idle state; and (l) producing a control signal using corrected basic fuel amount; and means for controlling the amount of fuel injected into the engine cylinders in accordance with said control signal.

7. Apparatus as claimed in claim 6, wherein said means for detecting comprises:

(a) a disc including a plurality of teeth on a peripheral portion thereof arranged to rotate in synchronization with the engine crankshaft; and (b) an electromagnetic pickup responsive to the passage of each tooth of said disc.

8. Apparatus as claimed in claim 6, wherein said means for controlling comprises a distributor injection pump having a spill ring arranged to be moved by an electromagnetic actuator responsive to said control signal.

* * * * *